US005205982A

United States Patent [19]

Fukase et al.

[11] Patent Number: 5,205,982

[45] Date of Patent: Apr. 27, 1993

[54] TUNDISH FLOW CONTROL

[75] Inventors: Hisahiko Fukase, Wollongong; Walter Blejde, Balgownie, both of Australia

[73] Assignees: Ishikawajima-Harima Heavy Industries, Co., Ltd., Tokyo, Japan; John Lysaght (Australia) Limited, Sydney, Australia

[21] Appl. No.: 787,428

[22] Filed: Nov. 4, 1991

[51] Int. Cl.[5] ..... B22D 41/22

[52] U.S. Cl. ..... 266/236; 222/600

[58] Field of Search ..... 266/236, 275; 164/420, 164/437, 438, 337; 222/600

[56] References Cited

U.S. PATENT DOCUMENTS

| | | | |
|---|---|---|---|
| 4,730,660 | 3/1988 | Tinnes et al. | 164/420 |
| 4,883,113 | 11/1989 | Matsui et al. | 164/437 |

FOREIGN PATENT DOCUMENTS

| | | |
|---|---|---|
| 1297937 | 11/1972 | United Kingdom . |
| 2027524A | 2/1980 | United Kingdom . |
| 2085126A | 4/1982 | United Kingdom . |
| 2102544A | 2/1983 | United Kingdom . |
| 2198979A | 6/1988 | United Kingdom . |

*Primary Examiner*—Scott Kastler

*Attorney, Agent, or Firm*—Nikaido, Marmelstein, Murray & Oram

[57] ABSTRACT

An apparatus for forming a strip of metal which includes: a tundish for receiving molten metal; a metal delivery nozzle located below the tundish in a position to receive molten metal flowing downward from the tundish; and a pair of chilled rollers, which are capable of being contra-rotated, positioned below the metal delivery nozzle which are adapted to receive molten metal from the metal delivery nozzle into a pool of molten metal formed above the nip of the roller. The tundish is equipped with a series of openings in the base thereof directed toward the metal delivery nozzle through which the molten metal flows, and with an outlet flow control means. The outlet flow control means is a movable plate with apertures therein which substantially coincide with the apertures in the base of the tundish. Means are provided to move the outlet control plate to cause its apertures to go into and/or out of alignment with the apertures in the base of the tundish and thereby regulate the flow of molten metal therethrough. One or more outlet flow control plates can be provided so that flow through all or only a portion of the tundish apertures can be regulated at any given time.

11 Claims, 5 Drawing Sheets

TUNDISH FLOW CONTROL

TECHNICAL FIELD

This invention is concerned with the control of molten metal flow from a tundish. It has particular but not exclusive application to controlling a molten metal flow in the casting of ferrous metal strip.

It is known to cast non-ferrous metals such as aluminium by continuous casting in a twin roll caster. Hot metal is introduced between a pair of contra-rotated horizontal casting rollers which are cooled so that metal shells solidify on the moving roller surfaces and are brought together at the nip between them to produce a solidified strip product at the outlet from the roller nip. The hot metal may be introduced into the nip between the rollers via a tundish and a metal delivery nozzle located beneath the tundish so as to receive a flow of metal from the tundish and to direct it into the nip between the rollers.

Although twin roll casting has been applied with some success to non-ferrous metals which solidify rapidly on cooling, there have been problems in applying the technique to the casting of ferrous metals. One particular problem has been the achievement of even cooling and solidification at the initial head end on commencement of a casting run to allow continuous casting to proceed. This problem is addressed by the invention disclosed in our co-pending Australian Patent Application No. PJ9458.

It has also been found that, when casting ferrous strip, in order to form a desired shape of strip it is particularly important to maintain a required metal flow distribution across the width of the casting rollers and defects can occur due to minor flow fluctuations from the required metal flow distribution. This requires more accurate control of the flow from the tundish than can be achieved with conventional equipment. The present invention provides apparatus for such accurate control of flow from a tundish.

Although the invention has been developed to overcome a problem which is particularly critical in the casting of ferrous strip, it may also be applied to the casting of non-ferrous metals, for example, aluminium or indeed to any process in which molten metal is to be delivered from a tundish.

DISCLOSURE OF THE INVENTION

According to the invention there is provided a tundish having a plurality of outlet openings for flow of metal from the tundish and fitted with outlet flow control means comprising moving plate means having a plurality of spaced apertures alignable with the tundish outlet openings to permit flow of metal from the tundish openings via the apertures in the moving plate means, and actuator means operable to move the moving plate means to move the apertures therein into and out of alignment with the tundish outlet openings for regulation of metal flow from the tundish.

The tundish may have a floor provided with said outlet openings in a generally linear array and the moving plate means may be disposed beneath the openings in the tundish floor.

The plate means may comprise one or more sliding plates mounted in slide mountings on the underside of the tundish floor so as to be slidable horizontally beneath the tundish outlet openings.

The plate means may comprise a plate provided with a plurality of said apertures and movable by the actuator means to move said plurality of apertures simultaneously into and out of register with respective outlet openings in the tundish.

Alternatively, or in addition, the plate means may comprise separate plates each provided with one of said apertures and independently movable by the actuator means.

The actuator means may comprise one or more pressure fluid cylinder units connected to the respective moving plate or plates.

The invention further provides apparatus for casting metal strip, comprising a pair of parallel casting rollers forming a nip between them, a metal delivery nozzle for delivering molten metal into the nip between the casting rollers, and a tundish for supply of molten metal to the metal delivery nozzle, wherein the tundish has a plurality of outlet openings for flow of metal from the tundish into the delivery nozzle and is fitted with outlet flow control means comprising moving plate means having a plurality of spaced apertures alignable with the tundish outlet openings to permit flow of metal from the tundish openings via the apertures in the moving plate means, and actuator means operable to move the moving plate means to move the apertures therein into and out of alignment with the tundish outlet openings for regulation of metal flow from the tundish into the metal delivery nozzle.

Said apparatus may further comprise fluid level monitoring means to monitor a level of fluid in the nip between the casting rollers and control means to control operation of the actuator means in response to changes in said level of fluid as monitored by the monitoring means.

BRIEF DESCRIPTION OF THE DRAWINGS

In order that the invention may be more fully explained, one particular embodiment will be described in detail with reference to the accompanying drawings in which.

BEST MODE OF CARRYING OUT THE INVENTION

Figure 1:
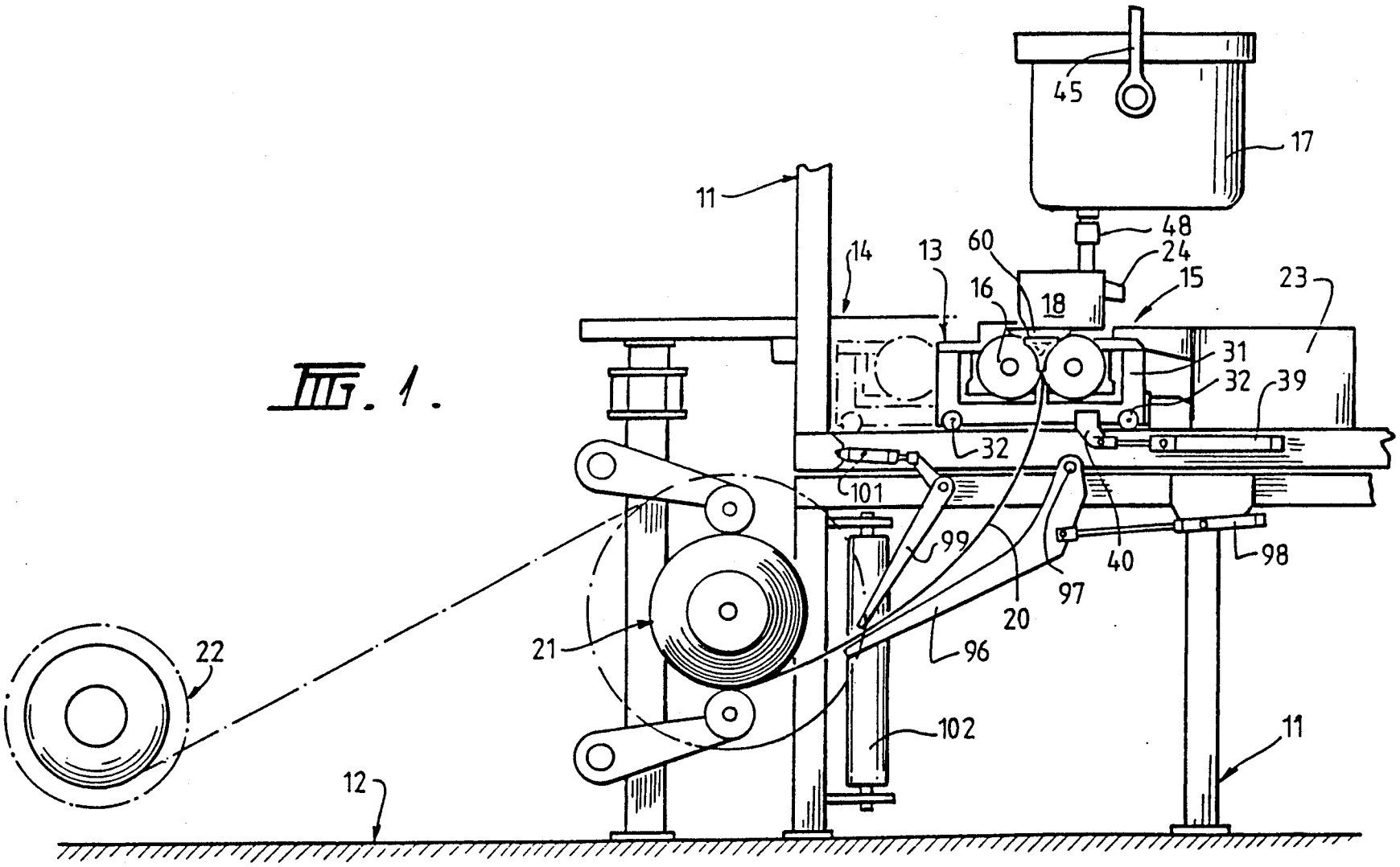
FIG. 1 illustrates a continuous strip caster incorporating apparatus constructed and operating in accordance with the present invention.
Figure 2:
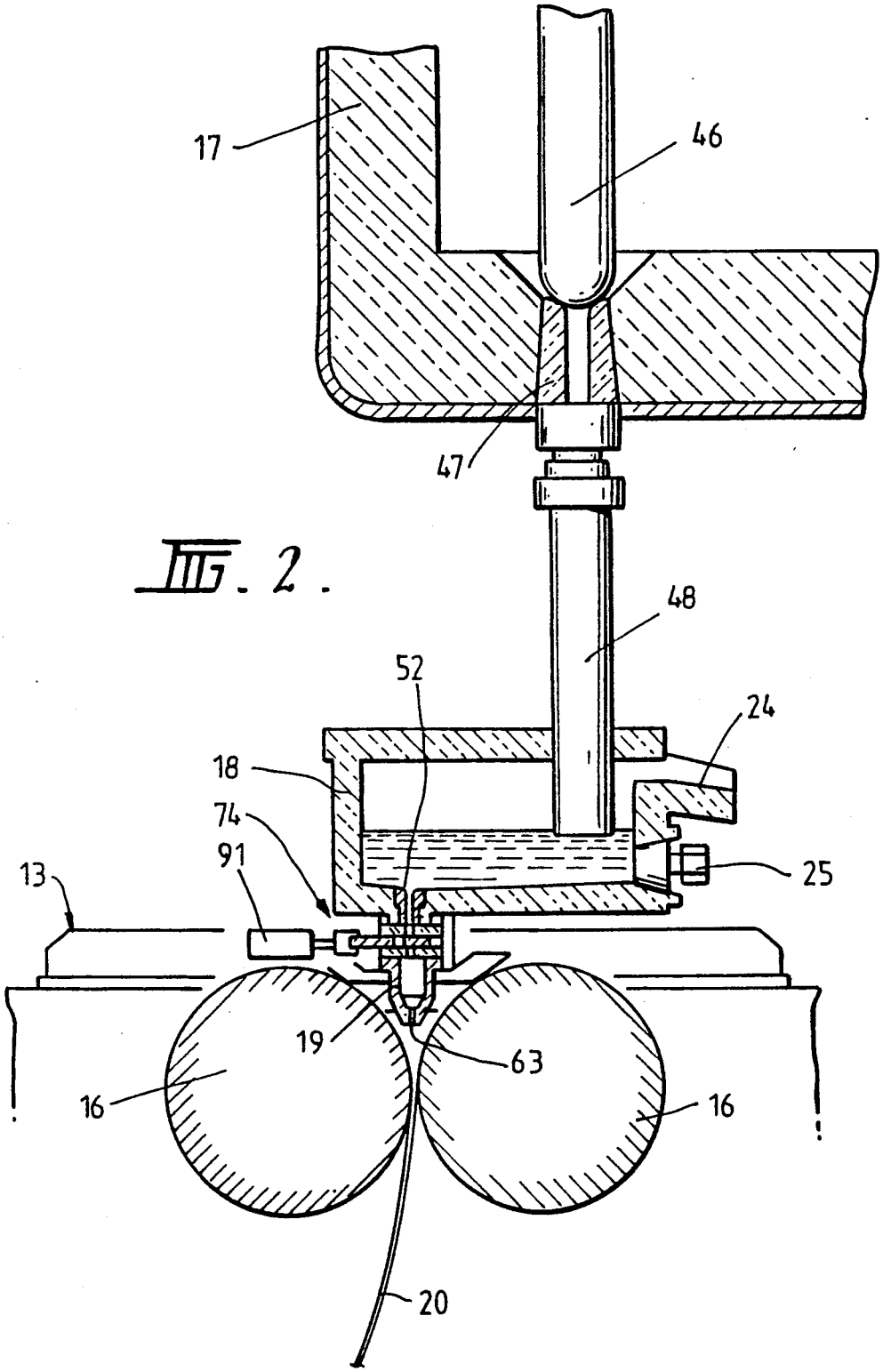
FIG. 2 is a vertical cross-section through important components of the caster illustrated in FIG. 1 including a metal delivery nozzle constructed in accordance with the invention.
Figure 3:
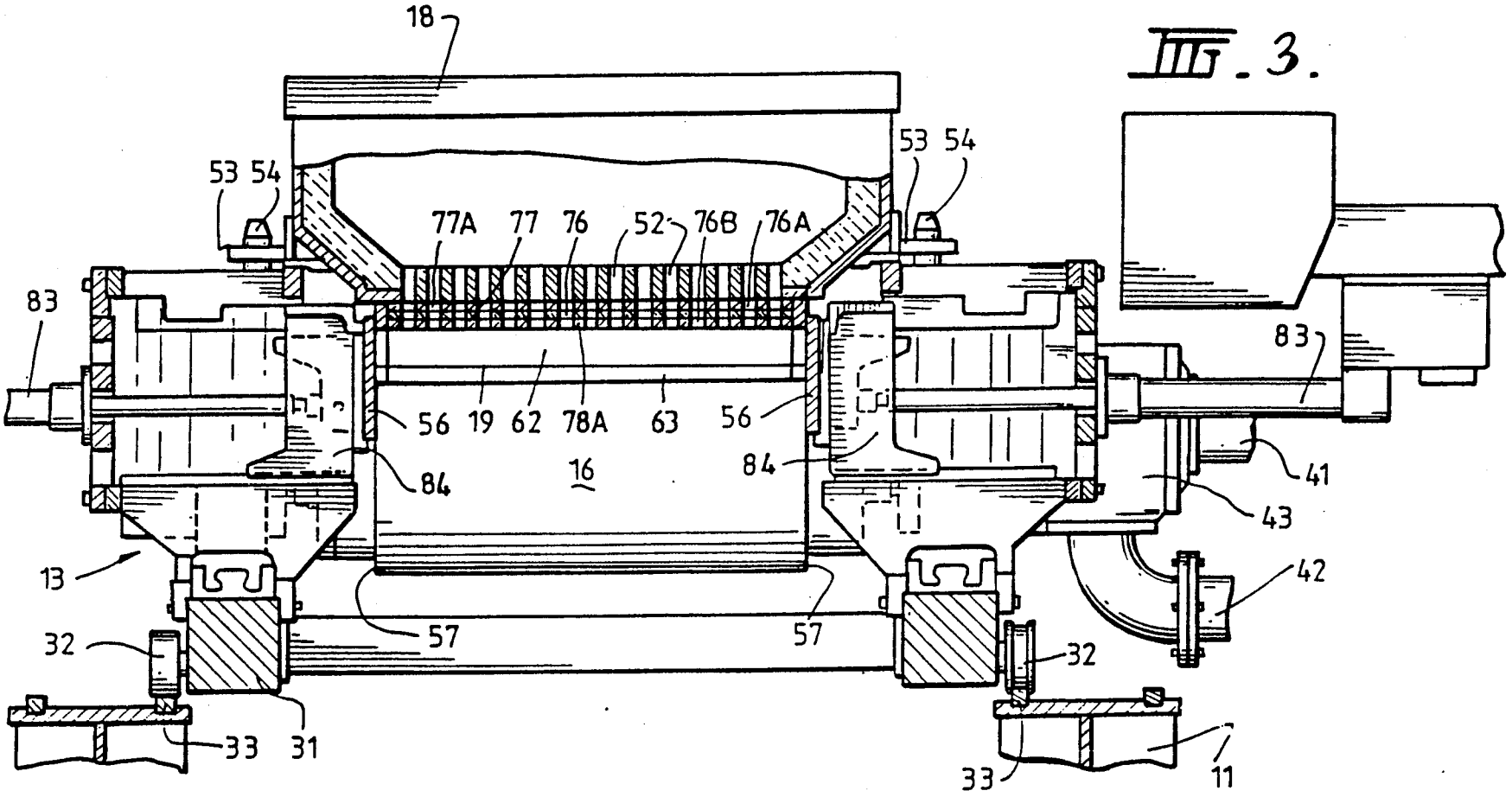
FIG. 3 is a further vertical cross-section through important components of the caster taken transverse to the section of FIG. 2.
Figure 4:
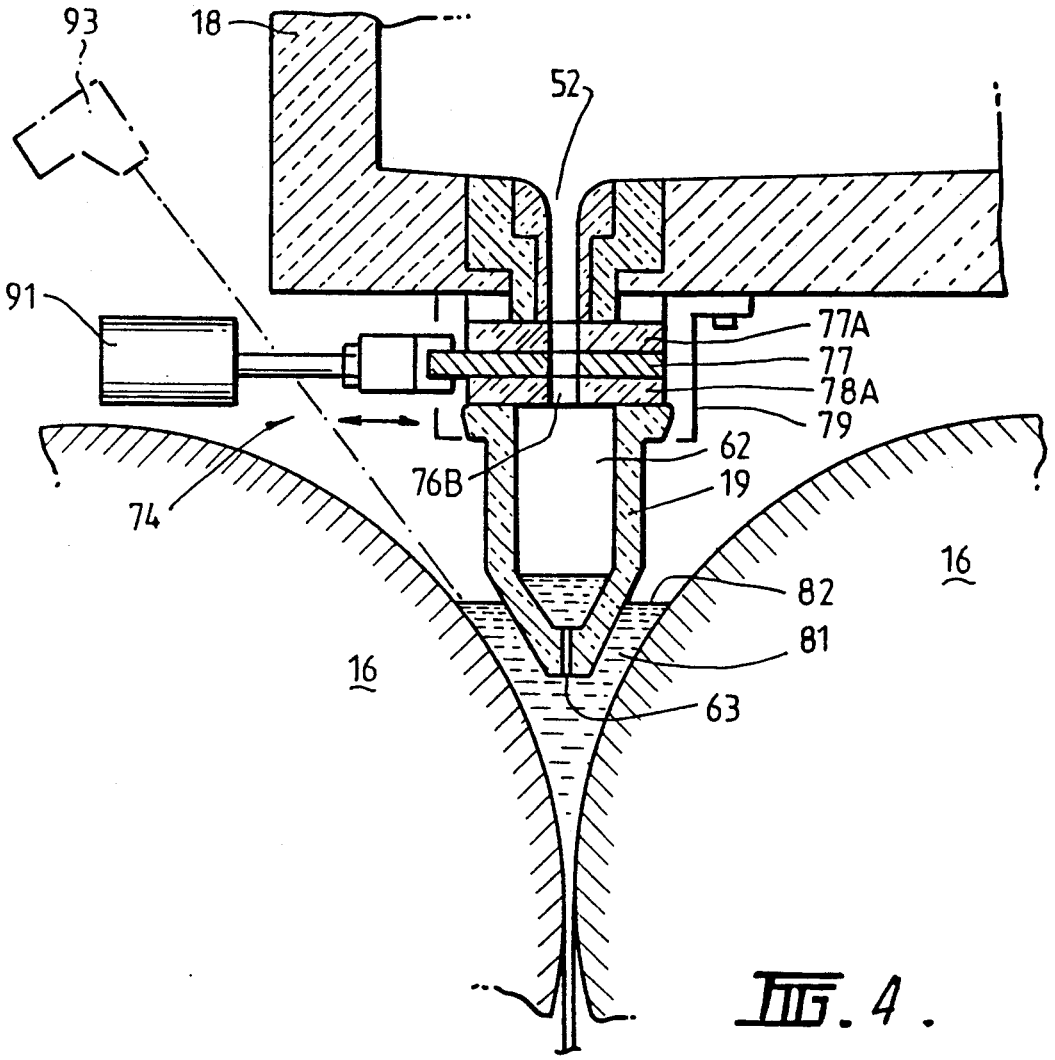
FIG. 4 is an enlargement of part of FIG. 2.
Figure 5:
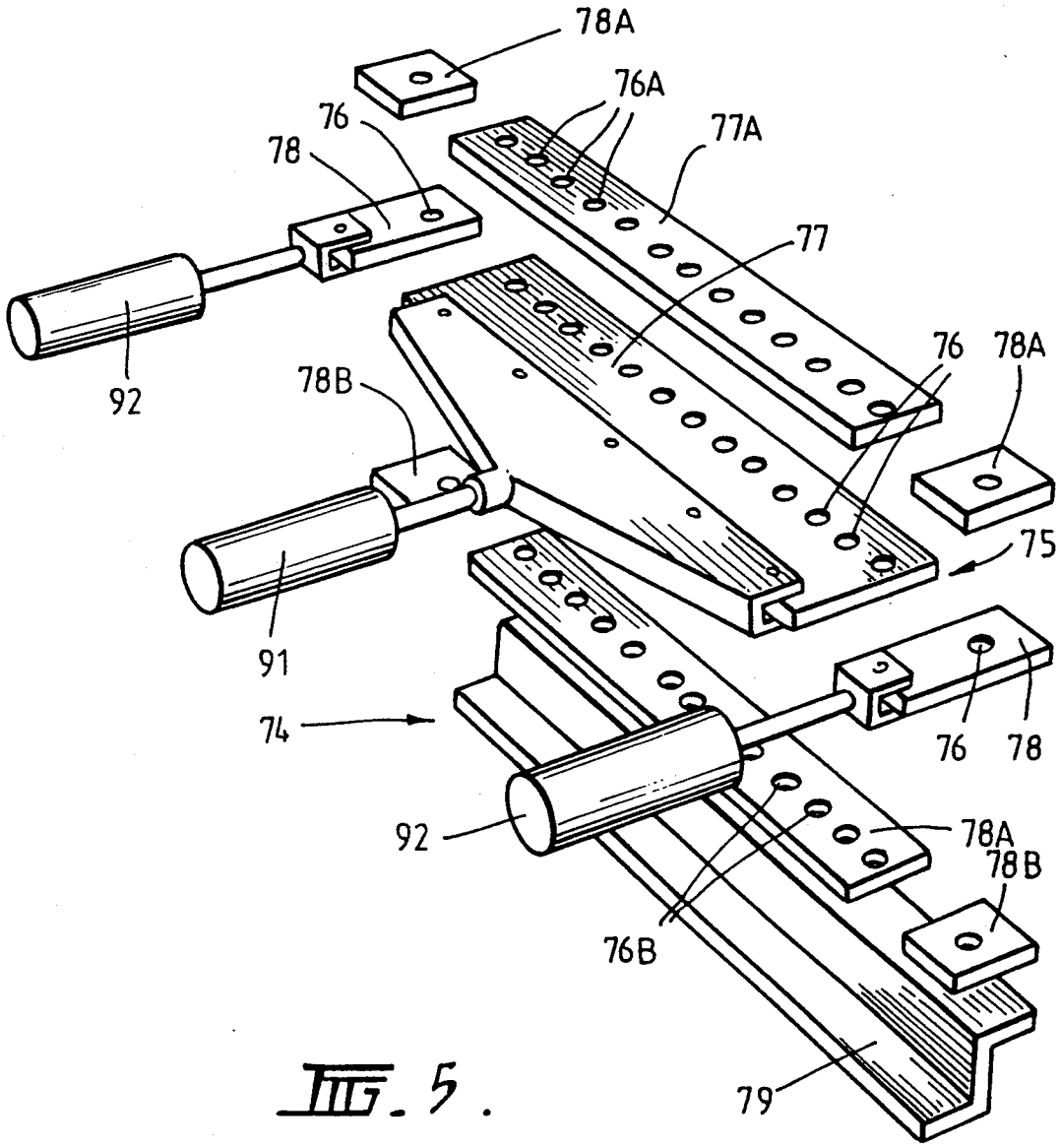
FIG. 5 is an exploded perspective of important components of the outlet flow control means of the caster.

The illustrated caster comprises a main machine frame 11 which stands up from the factory floor 12. Frame 11 supports a casting roller carriage 13 which is horizontally movable between an assembly station 14 and a casting station 15. Carriage 13 carries a pair of parallel casting rollers 16 to which molten metal is supplied during a casting operation from a ladle 17 via a tundish 18 and delivery nozzle 19. Casting rollers 16 are water cooled so that shells solidify on the moving roller surfaces and are brought together at the nip between them to produce a solidified strip product 20 at the roller outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the tundish or by withdrawal of an emergency plug 25 at one side of the tundish if there is a severe malformation of product or other severe malfunction during a casting operation.

Roller carriage 13 comprises a carriage frame 31 mounted by wheels 32 on rails 33 extending along part of the main machine frame 11 whereby roller carriage 13 as a whole is mounted for movement along the rails 33. Carriage frame 31 carries a pair of roller cradles in which the rollers 16 are rotatably mounted. Carriage 13 is movable along the rails 33 by actuation of a double acting hydraulic piston and cylinder unit 39, connected between a drive bracket 40 on the roller carriage and the main machine frame so as to be actuable to move the roller carriage between the assembly station 14 and casting station 15 and visa versa.

Casting rollers 16 are contra rotated through drive shafts 41 from an electric motor and transmission mounted on carriage frame 31. Rollers 16 have copper peripheral walls formed with a series of longitudinally extending and circumferentially spaced water cooling passages supplied with cooling water through the roller ends from water supply ducts in the roller drive shafts 41 which are connected to water supply hoses 42 through rotary glands 43. The rollers may typically be about 500 mm diameter and up to 1300 mm long in order to produce 1300 mm wide strip product.

Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into tundish 18.

Tundish 18 is formed as a wide dish made of a refractory material such as magnesium oxide (MgO). One side of the tundish receives molten metal from the ladle and is provided with the aforesaid overflow 24 and emergency plug 25. The other side of the tundish is provided with a series of longitudinally spaced metal outlet openings 52 fitted with outlet flow control means 74 to be described in detail below. The lower part of the tundish carries mounting brackets 53 for mounting the tundish onto the roller carriage frame 31 and provided with apertures to receive indexing pegs 54 on the carriage frame so as accurately to locate the tundish.

Delivery nozzle 19 is formed as an elongate body made of a refractory material such as alumina graphite. Its lower part is tapered so as to converge inwardly and downwardly so that it can project into the nip between casting rollers 16. A mounting bracket 60 is provided to support the nozzle on the roller carriage frame and the upper part of the nozzle is formed with outwardly projecting side flanges 55 which locate on the mounting bracket.

Delivery nozzle 19 has an internal vertically extending trough 62 to receive liquid flowing downwardly through the openings 52 of the tundish. Trough 62 converges toward its lower end part which serves as an outlet flow passage for flow of metal into the nip between the rollers 16. More specifically, the lower part of trough 62 terminates at an elongate outlet slot 63 at the bottom end of the delivery nozzle which slot extends longitudinally of the nip between the casting rollers.

In accordance with the present invention, tundish 18 is fitted with outlet flow control means denoted generally as 74 effective in association with the array of outlet openings 52 to regulate the flow of metal into the delivery nozzle 19. Flow control means 74 comprises a moving plate means 75 provided with a series of flow apertures 76 which can be moved into and out of alignment with the tundish outlet openings 52 by movement of the moving plate means. In the illustrated apparatus, moving plate means 75 comprises a central plate 77 provided with all but two of the apertures 76 and two separate end plates 78 which are provided with the two end apertures 76. These plates are slidably mounted between upper slide mounting plates 77A, 78A and lower slide mounting plates 77B, 78B which are held within a housing bracket 79 bolted to the underside of the tundish floor to serve as slide mountings for the sliding plates 77, 78.

The upper and lower slide mounting plates 77A, 78A, 77B and 78B are provided with upper and lower series of holes 76A, 76B which are aligned with the outlet openings 52 in the tundish floor. They therefore form with the openings 52 extended outlet openings for the tundish and the apertures 76 in the plate means 75 can be moved into and out of alignment with these extended openings by movement of the plate means.

The apertures 76 in the central plate 77 of the moving plate means, the aligned outlet openings 52 in the tundish floor, and the aligned holes 76A, 76B in the upper and lower slide mounting plates 77A, 78A, 77B, 78B may be of any suitable size and spacing to produce a required metal flow distribution across the width of the casting rollers to form a desired shape of strip. For example, the apertures 76, outlet openings 52 and holes 76A, 76B may be of uniform size and variable spacing. Alternatively, the apertures, outlet openings and holes may be of variable size and uniform spacing.

Plate means 75 is moved by an actuator means in the form of a central servo cylinder unit 91 connected to the central plate 77 and two outer servo cylinder units 92 connected to the two end plates 78. The sliding plates are movable by actuation of the servo cylinder units into and out of register with the extended outlet openings in the tundish to enable flow regulation from complete shut off to full flow conditions. The servo cylinder units are actuable independently to provide independent control of flow through of the two outer end apertures 76.

In operation of the illustrated apparatus, molten metal delivered from delivery nozzle 19 forms a pool 81 above the nip between the rollers, this pool being confined at the ends of the rollers by a pair of side closure plates 56 which are held against stepped ends 57 of the rollers by actuation of a pair of hydraulic cylinder units 83 fitted with closure plate holders 84. The upper surface 82 of pool 81, generally referred to as the "meniscus level" rises above the lower end of the delivery nozzle. Accordingly, the lower end of the delivery nozzle is immersed within this pool and the nozzle outlet passage extends below the surface of the pool or meniscus level. The flow of metal is also such as to produce a head or pool of molten metal within the lower part of the delivery nozzle to a height above the meniscus level 82.

The tundish flow control apparatus 74 enables accurate regulation of the flow from the tundish from complete shut off to full flow conditions and so allows accurate control of the metal flow distribution to the nip between the casting rollers. Without such control of the tundish outflow, control can only be maintained through actuation of the ladle stopper 46. This control is too indirect to quickly and accurately compensate for fluctuations in the metal flow distribution and, as a consequence, in the time lag required to enable adjustment of the metal flow distribution a significant amount of cast strip of unacceptable quality may be produced.

The actuator cylinders 91, 92 may be linked by servo control means to a pool level sensor to give automatic control of the level of pool 81. The sensor may be in the form of a video camera 93 which continuously monitors the pool level 82 and is linked to the servo cylinders so that a change in the pool level, which is indicative of a change in the metal flow distribution, will be counteracted by an automatic movement of the slide plates 77, 78 which produce a counteracting change in the metal flow rate from the tundish to restore the required metal flow distribution.

The slide plates 77, 78 and the upper and lower mounting plates may be formed of graphitised alumina. They may be of porous construction and connected to a supply of pressurised argon gas which can bubble out through the apertures within them to keep the apertures clean.

The illustrated apparatus has been advanced by way of example only and it could be modified considerably. For example, the moving plate means could be further subdivided into a larger number of independently movable plates to provide more precise control of the metal outlet flow across the width of the casting rollers. Selected groups of apertures could be movable independently or these may be a separate individually movable plate for each aperture to provide very fine control to eliminate nozzle marks in the final strip product. In another modification an elongate plate provided with a linear array of outlet apertures could rotate in the general plane of movement so that the linear array of apertures in the plate becomes slightly inclined to the array of tundish outlet openings to produce variations in the flow rate across the width of the strip. It is accordingly to be understood that the invention is in no way limited to details of the illustrated apparatus and that many variations will fall within the scope of the appended claims.

We claim:

1. In an apparatus for casting metal strip comprising a pair of parallel casting rollers forming a nip between them, a metal delivery nozzle disposed above and extending along the nip for delivery of molten metal downwards into the nip along its length, metal confining means at the ends of the nip to confine metal delivered into the nip by the metal delivery nozzle into a casting pool within the nip, and a tundish disposed above the metal delivery nozzle for downwardly supply of molten metal to the metal delivery nozzle, the improvement which comprises:

said metal delivery nozzle having an upwardly facing trough to receive metal from the tundish and flow passage means to permit the flow of metal form the trough to the nip between the rolls, said tundish having a plurality of outlet openings to permit the flow of metal into the trough as a plurality of falling streams spaced along the trough, tundish outlet flow control means comprising moving plate means having a plurality of spaced apertures aligned with said tundish outlet openings to permit flow of metal from the tundish openings into the trough via said apertures in said moving plate means, and actuator means operable to move said moving plate means whereby to move the apertures therein into and out of alignment with said tundish outlet openings to thereby regulate metal flow from said tundish into said trough of said delivery nozzle, and thereby also to regulate the flow of metal into said casting pool in the nip between the casting rollers.

2. Apparatus as claimed in claim 1, wherein said outlet openings are provided in a floor of the tundish in a generally linear array and said moving plate means is disposed beneath the openings in said tundish floor.

3. Apparatus as claimed in claim 2, wherein said plate means comprises one or more sliding plates mounted in slide mountings on the underside of said tundish floor so as to be slidable substantially horizontally beneath said tundish outlet openings.

4. Apparatus as claimed in claim 1, wherein said plate means comprises a plate having a plurality of said apertures which is moveable by said actuator means to move said plurality of apertures simultaneously into and out of register with respective outlet openings in said tundish.

5. Apparatus as claimed in claim 1, wherein said plate means comprises separate plates each provided with one aperture corresponding to one opening in said tundish and each independently moveable by said actuator means.

6. Apparatus as claimed in claim 1, wherein said actuator means comprises one or more pressure fluid cylinder units connected to said moving plate means.

7. Apparatus as claimed in claim 1, which further comprises pool level monitoring means to monitor the level of metal in said casting pool and control means to control the operation of said actuator means in response to changes in said pool level as monitored by said monitoring means.

8. Apparatus for casting metal strip, comprising a pair of parallel casting rollers forming a nip between them, a metal delivery nozzle for delivery molten metal into the nip between the casting rollers, and a tundish for supply of molten metal to the metal delivery nozzle, wherein said tundish has a plurality of outlet openings to permit the flow of metal from said tundish into said delivery nozzle and is fitted with outlet flow control means, comprising moving plate means having a plurality of spaced apertures alignable with said tundish openings via said apertures in said moving plate means, and actuator means operable to move said moving plate means to move said apertures therein into and out of alignment with said tundish outlet openings for regulation of metal flow from said tundish into said metal delivery nozzle, and wherein said plate means comprises a first plate provided with a majority of said apertures and two separate plates disposed one to each side of said first plate which separate plates are each provided with one of said apertures and are independently movable by said actuator means.

9. Apparatus as claimed in claim 8, wherein said actuator means comprises a plurality of pressure fluid cylinder units connected to said first and said separate plates adapted to move those plates independently of one another.

10. A tundish having a plurality of outlet openings for flow of metal therethrough from said tundish; an outlet flow control means, comprising moving plate means having a plurality of spaced apertures alignable with said tundish openings via said apertures in said moving plate means; and actuator means operable to move said moving plate means to move the apertures therein into and out of alignment with said tundish outlet openings for regulation of metal flow from said tundish, wherein said plate means comprises a first plate provided with a majority of said apertures and two separate plates disposed one to each side of the first plate which separate plates are each provided with one of said apertures and are independently movable by said actuator means.

11. A tundish as claimed in claim 10, wherein said actuator means comprises a plurality of pressure fluid cylinder units connected to said first and separate plates adapted to move those plates independently of one another.

* * * * *

UNITED STATES PATENT AND TRADEMARK OFFICE

CERTIFICATE OF CORRECTION

PATENT NO. : 5,205,982

DATED : April 27, 1993

INVENTOR(S) : FUKASE et al

It is certified that error appears in the above-identified patent and that said Letters Patent is hereby corrected as shown below:

On the cover page, please add item [30], foreign application priority data, --Australia Patent No. PK3502, dated November 26, 1990--.

Signed and Sealed this

Fourth Day of January, 1994

Bruce Lehman

*Attest:*

BRUCE LEHMAN

*Attesting Officer*

*Commissioner of Patents and Trademarks*